US006161223A

United States Patent [19]

Andrews

[11] Patent Number: 6,161,223

[45] Date of Patent: Dec. 19, 2000

[54] PANTS SEPARABLE AT CROTCH FOR STYLE MIXING

[76] Inventor: Allison Andrews, 1336 Landry Cir., Longwood, Fla. 32750

[21] Appl. No.: 09/405,969

[22] Filed: Sep. 27, 1999

[51] Int. Cl.[7] ..... A41D 1/06

[52] U.S. Cl. ..... 2/234; 2/227

[58] Field of Search ..... 2/234, 227, 228, 2/238, 405, 219, 220, 221, 235, 236, 237, 312, 333, 408, 301, 319

[56] References Cited

U.S. PATENT DOCUMENTS

| | | | |
|---|---|---|---|
| D. 231,155 | 4/1974 | Bowcut | D2/2 |
| 238,574 | 3/1881 | Clyde | 2/227 |
| 1,860,433 | 5/1932 | Rosenbaum | 2/227 |
| 2,166,514 | 7/1939 | Zapis | 2/67 |
| 2,703,404 | 3/1955 | Lawson | 2/79 |
| 3,823,419 | 7/1974 | Breitbart | 2/227 |
| 4,215,435 | 8/1980 | Miele | 2/227 |
| 4,554,684 | 11/1985 | Cadoret | 2/227 |
| 5,010,595 | 4/1991 | Stradley | 2/227 |
| 5,598,586 | 2/1997 | Munjone | 2/237 |
| 5,983,401 | 11/1999 | Ohara | 2/227 |

OTHER PUBLICATIONS

Gershman, Maurice: Journal of the American Medical Asso., vol. 168, p. 930, Oct. 1958.

*Primary Examiner*—John J. Calvert
*Assistant Examiner*—Alissa L. Hoey
*Attorney, Agent, or Firm*—John V. Stewart

[57] ABSTRACT

A pair of pants that is easily separable at the crotch into right and left leg portions. Each leg portion is selected from a set of various styles to flexibly create a custom mixed or matched style for a given wearing of the pants. A closure system is provided for quick and convenient separation and re-combination of the leg portions while also providing secure use of the pants.

8 Claims, 2 Drawing Sheets

PANTS SEPARABLE AT CROTCH FOR STYLE MIXING

BACKGROUND OF THE INVENTION

1. Field of the Invention

This invention relates to trousers or pants that are separable at the crotch into left and right pant legs each pant leg chosen from a set of pant legs of various fashion styles.

2. Description of Prior Art

Some U.S. patents show garments that are separable into left and right halves for extra convenience or special needs for dressing and undressing in certain situations, or for adjusting the fit of the garment. These include U.S. Pat. No. 429,665 (Tozer), U.S. Pat. No. 2,166,514 (Zapis), and U.S. Pat. No. 2,703,404 (Lawson). However, style mixing is not provided as in the present invention.

U.S. Pat. No. 4,215,435 (Miele) shows pants having legs formed of multiple releasable horizontal bands, some or all of which can be removed to shorten the legs incrementally from full length to short shorts. Unlike the present invention they are not separable at the crotch into left and right pant legs, and their style range is limited because it always includes physical banding of the legs.

U.S. Pat. No. 4,578,828 (Smith Sr. et al) shows pants with a slide fastener from the front to the back waistband, but not opening the back of the waistband. It allows women to use a toilet without sliding the pants down. It does not allow style mixing as in the present invention.

U.S. Pat. No. 5,204,995 (Knapp) shows pants that are reversible inside out for two style options. It does not allow left and right style mixing as in the present invention.

There is no suggestion in the prior art for providing a set of pants in which members of the set are created temporarily as needed by combining left and right halves of different styles. Thus a relatively large set of different styled pants is provided by a relatively small set of pant legs. This allows increased variety in a user's wardrobe at reduced expense.

SUMMARY OF THE INVENTION

The objectives of the present invention are provision of a set of left and right pant legs in a variety of styles that can be easily combined by a user to create pants of many different appearances with mixed or matched left and right leg styles.

These objectives are achieved in a pair of pants that is easily separable at the crotch into right and left leg portions. Each leg portion is selected from a set of various styles to flexibly create a custom mixed or matched style for a given wearing of the pants. A closure system is provided for quick and convenient separation and re-combination of the leg portions while also providing secure use of the pants.

REFERENCE NUMBERS

Figure 3:
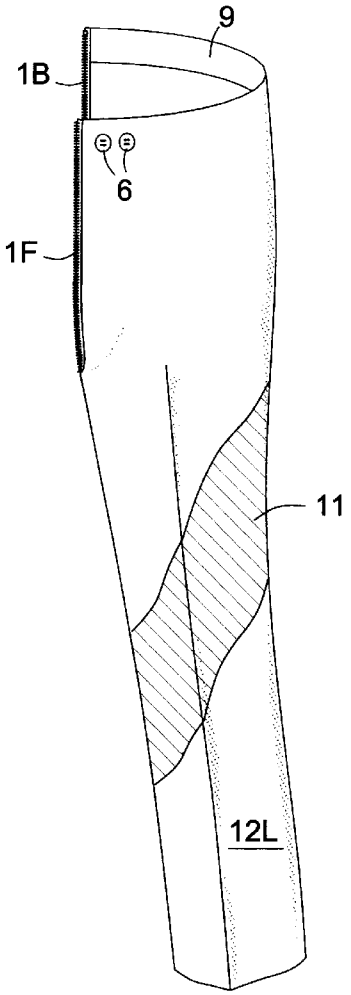
FIG. 3 is a front view of a left pant leg of a second style.

1F. Front portion of slide fastener (zipper)

1B. Back portion of slide fastener (zipper)

2. Slide of slide fastener

3. Slide fastener pull ring

4. Waist front safety strap

5. Waist back safety strap

6. Button

7. Crotch safety strap

8. Button closure

9. Waist band

10. Pattern or style 1

11. Pattern or style 2

12R. Right pant leg

12L. Left pant leg

TERMINOLOGY

"Left" and "right" orientations are in relation to a wearer of the pants.

DESCRIPTION OF THE PREFERRED EMBODIMENTS

Figure 2:
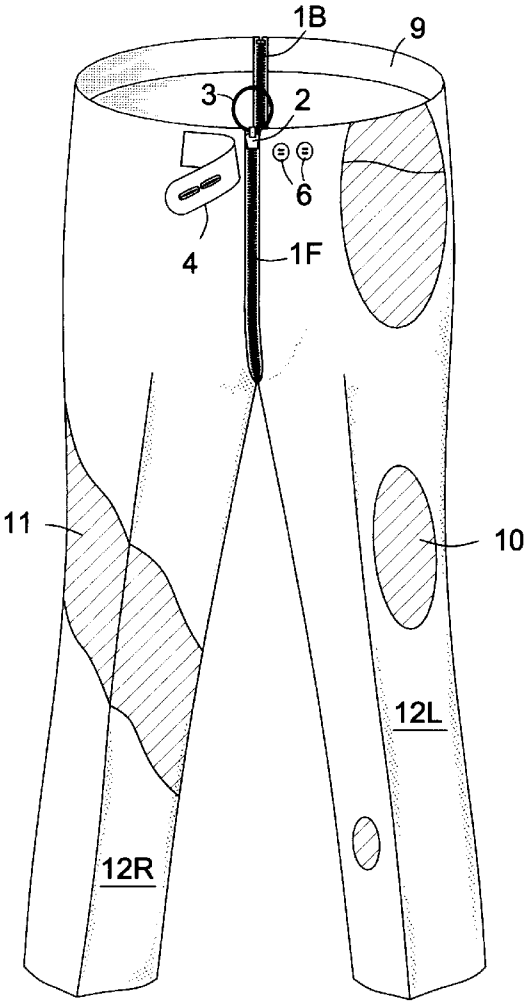
FIG. 2 is a front view of combined left and right pant legs of different styles.
Figure 1:
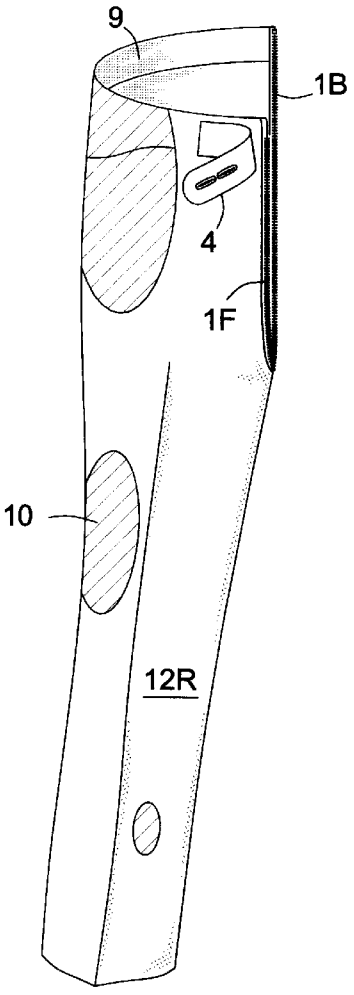
FIG. 1 is a front view of a right pant leg of a first style.

FIG. 2 shows a pair of pants formed by attaching a left leg 12L and a right leg 12R by means of a continuous fastener 1F–1B along a closure line defining a releasable seam. A safety strap 4 with buttons is provided for securing closure at the front of the waist. A ring 3 is preferably provided on the slide fastener slide 2. This ring hangs over the closed strap 4, to prevent unzipping. Alternately a conventional slide with a locking tab may be used. A continuous flap of fabric should cover the slide fastener on the inside of the garment to prevent catching of the slide fastener on the user's underclothing or skin. For the sake of clarity, this flap is not shown in the drawings. Optionally, such a flap may be provided on the outside of the garment as well.

Two patterns 10 and 11 are used for illustration purposes to represent any style difference, including fabric, pattern, color, etc. between the left and right legs. Users may purchase matching left and right legs in order to have symmetric design options, or they may purchase only the mixed combinations desired.

Figure 4:
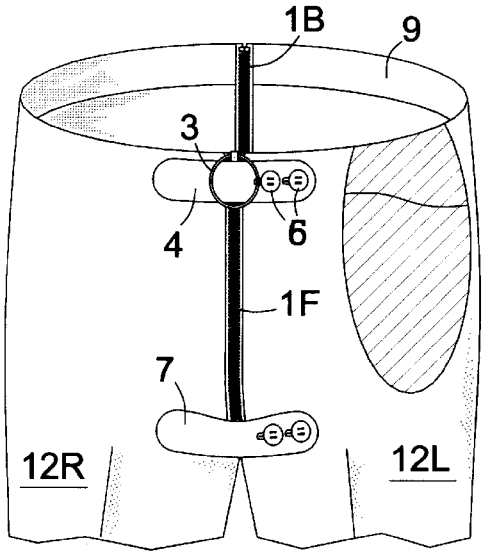
FIG. 4 is a partial front view of combined pants showing front safety straps 4 and 7.
Figure 5:
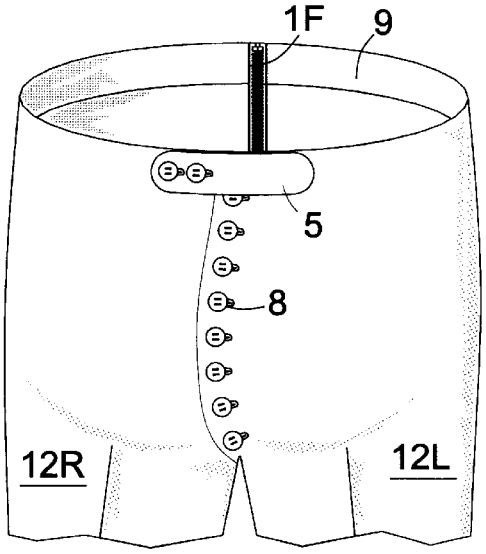
FIG. 5 is a partial back view of combined pants showing alternate button closure for the back.
Figure 6:
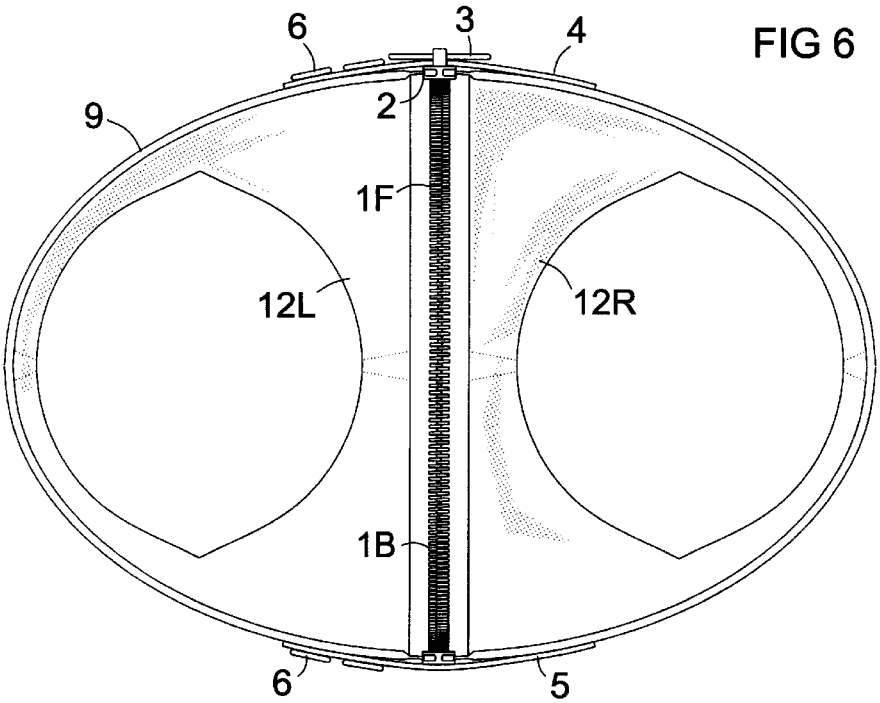
FIG. 6 is a top view of FIG. 1.

The closure mechanism may be a slide fastener as shown, or any releasable fabric closure device, such as buttons, hook and loop fabric such as Velcro, laces, snaps, hooks, and the like. Safety straps may be provided for additional security. Examples of front and back safety straps are shown in FIGS. 4 and 5. In FIG. 4 a safety strap 7 is provided at the bottom front of the crotch. The slide fastener can be unzipped to this point for removal of the pants from the user, without overstressing the slide fastener. This strap also prevents unzipping past the point of convenience. The ring 3 hangs over this crotch strap, holding the slide fastener at that point.

Instead of a continuous single slide fastener as shown in FIGS. 1–4 and 6, a separate slide fastener for the front and back may be provided, each slide fastener starting at the bottom of the crotch. In this configuration, one or two safety straps on the bottom of the crotch is suggested. Combinations of closure devices may be used as illustrated in FIG. 5, which shows a slide fastener 1F in front, and buttons 8 in the back.

To use the invention, a user selects a left and right pant leg to be combined according to preference, attaches the two pant legs along the back portion of the closure system, including back safety strap(s), connects the lower front safety strap, then pulls on the pants and fastens the front closure and front waist safety strap. To remove the pants, the user opens the front waist safety strap, and opens the front closure down to the bottom of the crotch, then pulls the pants down.

This system saves money by providing a pair of pants that is selectable from the set of all combinations of the left legs against the right legs. Since most members of the combination set do not physically exist at any given time, the user has a large selection set for a fraction of the price. This is due to the flexibility of reconfiguring the pants.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention. The invention can be embodied in shorts as well as long pants.

I claim:

1. A pair of outerwear pants having front and back sides and a crotch, the pants separable into right and left leg portions by a releasable closure system defining a seam spanning from the front to back sides of the pants through the crotch, the closure system having left and right portions, each left leg portion having the left half of the closure system, and each right leg portion having the right half of the closure system, each leg portion selected from a set of one-piece left and right leg portions having a variety of visual effects, whereby a user can flexibly create a custom style for a given wearing of the pants.

2. The pair of pants of claim 1, wherein the closure system comprises a slide fastener, a front waist security strap, a back waist security strap, and a front lower crotch security strap, each of the security straps crossing over the slide fastener and having left and right attachments on the respective leg portions, at least one of the two attachments per security strap being releasable.

3. The pair of pants of claim 1, wherein the closure system comprises a front slide fastener portion, a back button portion, and a front waist security strap.

4. A set of left and right outerwear pant legs having a variety of visual effects, each leg having a single visual effect, and having a waistband with a front and back end, each of the left legs of the set being releasably attachable to each of the right legs of the set along a closure line spanning between the front and back ends of the waist bands.

5. The set of left and right pant legs of claim 4, wherein the closure line comprises a slide fastener, a front waist security strap, a back waist security strap, and a front lower crotch security strap, each of the security straps crossing over the slide fastener and having left and right attachments on the respective pant legs, at least one of the two attachments per security strap being releasable.

6. The set of left and right pant legs of claim 5, wherein the slide fastener has a slide with an outwardly extending ring-mounting boss, and a pull-ring pivotally mounted in the boss for operating the slide fastener.

7. The set of left and right pant legs of claim 4, wherein each leg has front and back sides, and the closure line comprises a front slide fastener portion, a back button portion, and a front waist security strap.

8. A method for creating a customized visual effect for a given wearing of pants comprising the steps of:

a) providing a set of left and right outerwear pant legs having a variety of visual effects, each leg having one visual effect;

b) providing means to securely releasably attach each left leg of the set to each right leg of the set;

c) selecting a left pant leg having a first visual effect form the set;

d) selecting a right pant leg having a second visual effect from the set; and e) attaching the selected left and right pant legs together to form a pair of pants with an asymmetric visual effect.

* * * * *